United States Patent [19]

Walter

[11] Patent Number: 4,571,582

[45] Date of Patent: Feb. 18, 1986

[54] FAULT PRE-WARNING DEVICE FOR USE IN CARPET MANUFACTURING MACHINES

[75] Inventor: Arthur Walter, Waldkirch, Del.X

[73] Assignee: Erwin Sick GmbH Optik-Elektronik, Waldkirch, Fed. Rep. of Germany

[21] Appl. No.: 505,158

[22] Filed: Jun. 17, 1983

[30] Foreign Application Priority Data

Jun. 21, 1982 [DE] Fed. Rep. of Germany ..... 3223054

[51] Int. Cl.[4] ..... G08B 21/00

[52] U.S. Cl. ..... 340/677; 28/187; 66/163; 139/354; 340/668; 340/675

[58] Field of Search ..... 340/677, 675, 668; 28/187; 66/163, 161, 166; 139/354, 353, 368

[56] References Cited

U.S. PATENT DOCUMENTS 2,825,119 3/1958 Heffelfinger et al. ..... 28/187
3,221,683 12/1965 Abelsma .
3,938,119 2/1976 Schwartz ..... 340/677
4,364,247 12/1982 Muns-Magem et al. ..... 66/163

FOREIGN PATENT DOCUMENTS 487523 12/1929 Fed. Rep. of Germany .
2819951 11/1978 Fed. Rep. of Germany .
2936055 3/1980 Fed. Rep. of Germany .
2908471 10/1980 Fed. Rep. of Germany .
641457 1/1949 United Kingdom .

*Primary Examiner*—Glen R. Swann, III
*Attorney, Agent, or Firm*—Townsend and Townsend

[57] ABSTRACT

A fault pre-warning device for use in tufting machines has a switching strip (11) over which the carpet web is guided in such a way that the switching strip (11) is acted on by a defined force in the switching direction. On the occurrence of excessive tension in one or more of the warp threads the switching strip (11) initiates a switching process.

13 Claims, 4 Drawing Figures

FAULT PRE-WARNING DEVICE FOR USE IN CARPET MANUFACTURING MACHINES

BACKGROUND OF THE INVENTION

The invention relates to a fault pre-warning apparatus for use in textile machines for textile webs having warp threads, in particular tufted carpets.

An apparatus for automatically stopping the winding reel of dyeing and washing machines for lengths of textile material is known from German Pat. No. 487 523. In this apparatus the winding reel includes a movable bar mounted parallel to the rotational axle thereof. The movable bar is connected to the axle of the winding reel by two inclined parallel links forming a parallelogram linkage. If the frictional drag on the spring biased movable bar increases, e.g. due to sticking of the material, the inclined links execute a circular arc movement and the end of the bar moves axially relative to the axle of the winding reel. This axial movement of the bar trips a mechanism which disengages the drive for the winding reel. The disadvantage of this known fault pre-warning apparatus is the considerable mechanical complexity and the fact that the apparatus only responds to the total tension in the web of material. Locally excessive tensions do not lead to the initiation of a switching process.

A known device for carrying out tension measurements (German laying open print No. 28 19 951) admittedly does not exhibit this disadvantage, however this device requires numerous pressure sensors which are arranged transverse to the direction of movement of the web and which are moreover journalled on ball bearings.

SUMMARY OF THE INVENTION

In contrast, the principal object underlying the present invention is to provide a fault pre-warning apparatus of the initially named kind which, although of extremely simple construction, can also indicate the presence of narrowly confined, localised, excess tensions in the web which are brought about by warp threads stretched to breaking point.

In order to satisfy this object there is envisaged, in accordance with the present invention fault pre-warning apparatus for use in textile machines for textile webs having warp threads, in particular tufted carpets, wherein the textile web is guided over an elongate switching device and acts on this switching device with a defined force which, for a correctly tensioned web, is not sufficient to produce switching but which, when the web is tensioned excessively initiates a switching process with the aid of which the advance of the web can be stopped, characterised in that the switching device is an electrical switching strip which can initiate a switching process over its whole length, even with only local exertion of pressure, and in that the switching strip is connected to an electronic processing circuit which initiates a warning and/or stop signal when the tensions in the warp threads of the web exceed a predetermined tension at any point.

The invention starts from the recognition that prior to breaking of a warp thread, this warp thread is subjected to an above normal tension. It is thus possible to timely recognise the danger of breakage before the occurrence of a break by measuring and continuously monitoring this tension in each region across the width of the web. A switching strip, as proposed by the present invention, represents an extremely simple means for determining the existence of excessive tensions in specific regions of the web and, although it requires hardly any space is nevertheless very effective. The switching strip responds each time an excessive warp tension occurs and indeed independently of the position along the length of the switching strip at which this excessive tension exists. A warning or stop signal is also initiated when excess tensions occur at several positions across the width of the web.

In the simplest case the switching strip is straight and is as long as the web is wide. In particular, the switching strip extends in the direction of the width of the web.

It is however also possible for several switching strips to be arranged one after the other across the width of the web.

The web is preferably moved at right angles to the switching strip which results in a particularly compact and efficient arrangement.

The switching strip is conveniently actuated by pressure on one of its side surfaces. For this purpose the web should be guided over the side surface with an arc of contact. The longitudinal tension present in the web in the direction of movement then leads to a pressure on the switching strip in the switching direction.

A preferred and particularly compact constructional arrangement is obtained when the web is guided towards and/or away from the switching strip via rollers provided at both sides of the switching strip, with the rollers being arranged displaced from the side surface of the switching strip at which the web is guided in order to form the arc of contact.

It is particularly expedient for the switching strip to have a pair of contact bands of resilient sheet metal which are held spaced apart by insulating strips. For this purpose the contact band facing the side surface of the switching strip which guides the web should have inclined slots separated by webs. A contact band pair of this kind for switching strips is known per se from German laying open print No. 29 08 471.

The contact band pair is preferably embedded in an elongate elastic section of synthetic material which is provided with said side surface which guides the web, with said side surface being essentially part cylindrical.

A particularly reliable actuation, which does not require forces which are too high, is obtained if the synthetic hollow section has an elongate hollow cavity above the pair of contact bands and if a longitudinal rib extends into the hollow cavity from the side surface on which the rib acts, with the longitudinal web contacting the outer contact band.

As the surface of the switching strip on which the web acts is subjected to considerable abrasion due to friction, a foil of abrasion resistant elastic material, for example CR-steel should be arranged, in accordance with a preferred embodiment of the invention, between the switching strip and the web. A further possibility for achieving an abrasion resistant arrangement is the provision of a row of directly adjacent, pivotably and/or displaceably disposed guide shoes of wear resistant material between the switching strip and the web. In the latter embodiment guide grooves which extend in the direction of movement of the web can be provided in the surfaces of the guide shoes.

In order to effectively avoid untimely initiation of the switching device the switching strip should be secured to a fixed base of the machine. As the switching force can be increased for a constant longitudinal tension of the web by reducing the angle of contact $\alpha$ the switching strip should preferably be vertically adjustably arranged. The sensitivity of the device can thus be modified by suitable vertical adjustment. With increasing vertical adjustment of the switching strip, the force exerted by the web on the switching strip increases so that a switching process is initiated even with trivial abnormal increases in the longitudinal tension.

BRIEF DESCRIPTION OF THE DRAWINGS

The invention will now be described in the following by way of example and with reference to the drawings in which are shown.

DETAILED DESCRIPTION OF THE PREFERRED EMBODIMENTS

Figure 1:
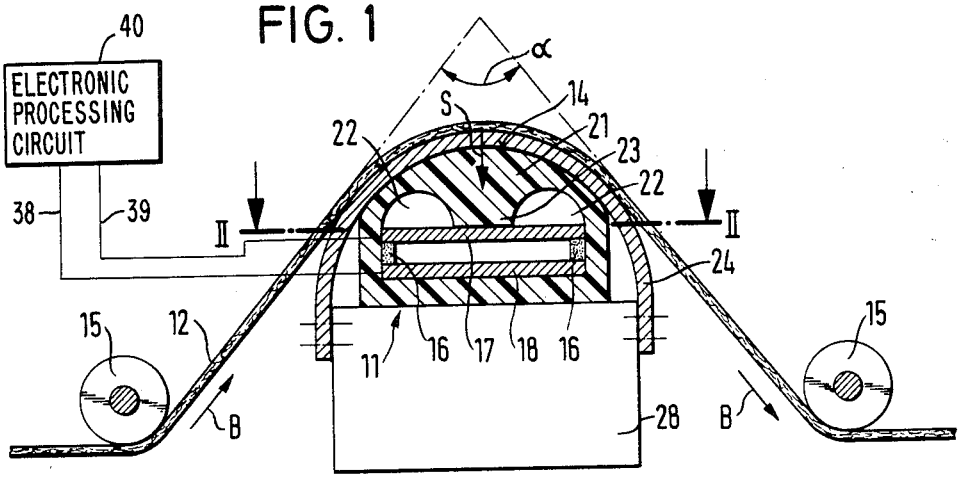
FIG. 1 a partially sectioned end view of a fault prewarning apparatus in accordance with the invention with a carpet web guided thereover, FIG. 2 a section on the line II—II in FIG. 1, FIG. 3 a partly sectioned end view analogous to FIG. 1 but of a further embodiment, and FIG. 4 a plan view of the arrangement of FIG. 3 in which the web 12 is broken away in the area of the guide shoes 25.
Figure 2:
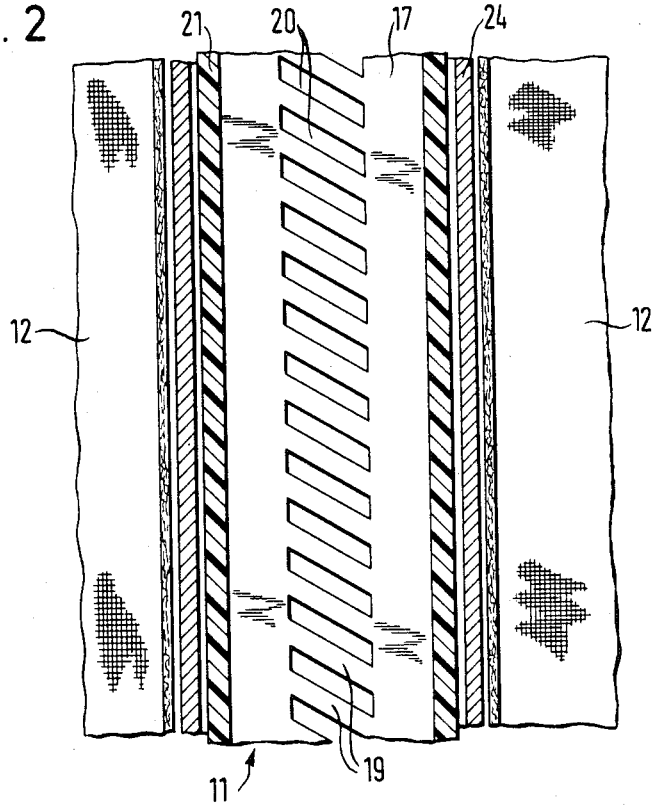

As seen in FIGS. 1 and 2 a carpet web 12, which is subjected within a tufting machine (or at the end of a tufting machine) to a longitudinal tension extending in the direction of movement B, is initially upwardly deflected over an elongate roller 15 and is then guided downwardly at an inclined angle to a further elongate roller 15 via a switching strip 11 which is rounded at the top in accordance with the invention. The web 12 passes around the switching strip 11 with an arc of contact $\alpha$. In this way the web exerts a force S on the switching strip 11 in the direction of the arrow and this force becomes larger as the arc of contact $\alpha$ is made smaller. In other words the displaced arrangement of the switching and the elongate rollers 15 serves to transform the longitudinal tension of the web 12 into a switching force S at the switching strip.

The switching strip 11 consists of an elongate synthetic section or molding 21 in which a pair of contact bands is embedded, with the pair of contact bands consisting of sheet steel contact bands 17, 18 which are arranged parallel to one another. Insulating strips 16 which hold the two contact bands 17, 18 spaced apart from one another are located between the contact bands 17, 18 at the edges thereof.

Whereas the inner contact band 18 is continuous the outer contact band 17 has, as can be seen in FIG. 2, a plurality of inclined slots 20 which are arranged alongside one another and between which webs 19 are located. At least the contact band 17 should consist of spring steel. A hollow cavity 22 is provided in the synthetic section 21 above the pair of contact bands 17,18 and a longitudinal rib 23 which contacts the contact band 17 extends into this hollow cavity from above.

The upper surface 14 of the synthetic hollow section 21 is of part cylindrical shape so that the web 12 is guided in the manner shown in FIG. 1 over a rounded surface.

As seen in FIGS. 1 and 2 a wear resistant foil 24 which is curved in accordance with the surface 14 is located between the surface 14 and the web in contact with the surface 14. The foil 24 is secured at its sides to the base 28 on which the switching strip 11 is mounted. The foil can, for example, consist of steel 0.05 to 0.1 mm thick; it can also be manufactured from another material.

The ends of the two contact bands 17, 18 are connected by wires 38,39 to an electrical processing circuit 40 which transmits a warning and/or stop signal when the two contact bands 17, 18 touch one another.

The manner of operation of the described fault prewarning device is as follows:

In normal operation of the tufting machine the force S at the switching strip 11 generated by the longitudinal tension in the web 12 is not sufficient to resiliently press the upper contact band 17 downwardly by an amount sufficient that it comes into electrical contact with the contact band 18.

If however, as a result of a fault, an increased longitudinal tension occurs at some point across the width of the web then the force S in the switching direction increases sufficiently that the contact band 17 is resiliently pressed downwardly via the longitudinal rib 23 so that it comes into electrical contact with the contact band 18. A warning and/or stop signal is now transmitted from the non-illustrated electronic processing circuit.

As soon as the normal tension conditions have been reestablished the contact band 17 lifts again from the contact band 18 as a result of its own elasticity, and that of the synthetic hollow section 21, and the normal operation of the machine continues.

Figure 3:
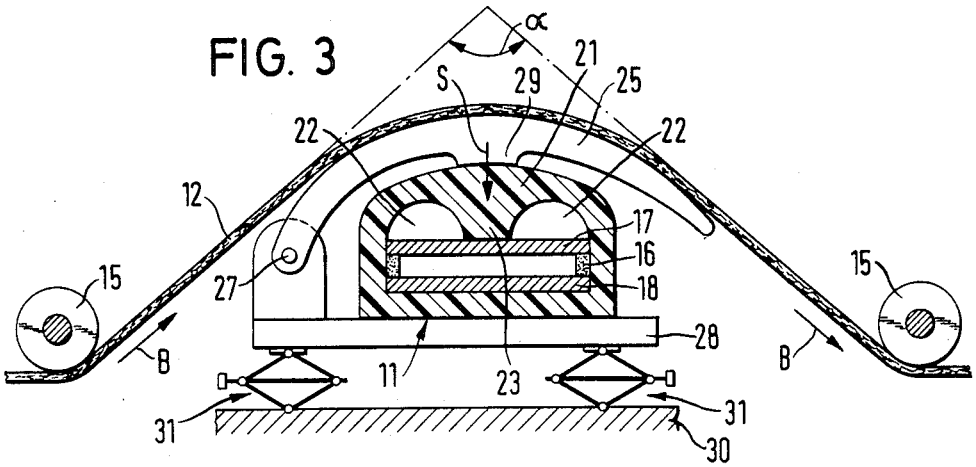
Figure 4:
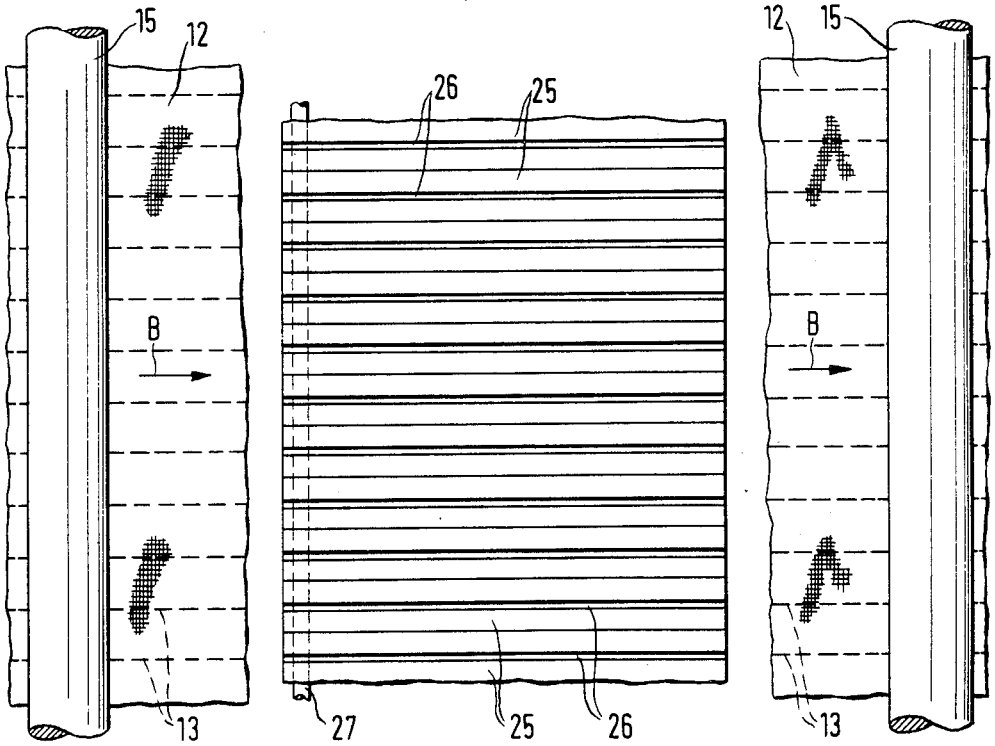

In FIGS. 3 and 4 the same reference numerals are used to designate parts which have counter-parts in FIGS. 1 and 2.

In distinction to the preceding embodiment guide shoes 25 are arranged between the synthetic hollow section 21 and the web 12. These guide shoes 25 are, for example, pivotally connected to the base 28 at one side of the switching strip 11 about a pivot axle 27 which extends parallel to the switching strip 11. As seen in FIG. 4 the guide shoes 25 lie directly adjacent one another and are secured to the pivot axle 27. They extend in arcuate manner over the switching strip 11 and spaced apart therefrom at right angles to its longitudinal axis. Each guide shoe 25 has an inwardly facing projection 29 above the apex of the switching strip 11 by means of which it contacts the synthetic hollow section 21 above the rib 23.

In order to guide the warp threads 13, which are only schematically illustrated in FIG. 4, guide grooves 26 which extend in the direction of movement B of the web 12 are provided in the outer surfaces of the guide shoes 25 as can be seen in FIG. 4.

The guide shoes 25 consist of abrasion resistant material such as porcelain, chrome steel or Delrin.

In analogy with the embodiment of FIGS. 1 and 2 the switching force S is transmitted in the embodiment of FIGS. 3 and 4 to the switching strip 11 via the guide shoes 25.

In the embodiment of FIG. 3 a vertical adjustment device 31 is also illustrated between the base 28 and a fixed part 30 of the machine. The arc of contact $\alpha$ (FIG. 1), and thus the switching force S for a given longitudinal tension of the web 12, can be changed by raising or lowering the base 28 relative to the elongate rollers 15. The elongate rollers 15 could also be vertically adjustably constructed in analogous manner.

With switching strips in accordance with the invention a force per centimeter length of 400 to 500 g is required in the embodiments in order to initiate a switching process. If one is using an arc of contact of approximately 90°, which is the preferred angle, a switching process is initiated when the tension of an individual thread amounts to 150 to 250 g.

Whereas the arc of contact $\alpha$ preferably amounts to 90° it can also lie in a range from 60° to 120° in order to obtain a good transformation of the longitudinal tension into switching forces.

What is claimed is:

1. In fault pre-warning apparatus for textile manufacturing machines of the kind in which a plurality of threads are led alongside one another past a switching strip to a production position for the production of a textile web; in which said switching strip comprises an elongate hollow elastic section having a longitudinal axis, an elongate hollow cavity, and first and second contact bands positioned spaced apart and confronting one another in said hollow cavity within said hollow section to initiate at least one of a warning signal and a stop signal when contact is established between said first and second contact bands as a result of the tension in one or more of said threads exceeding a predetermined tension, the improvement wherein said switching strip has an elongate curved guide surface and a rib extending from said guide surface inwardly into said hollow cavity into contact with said first contact band, and wherein said filaments pass directly over said guide surface substantially perpendicular to the longitudinal axis thereof and are wrapped around said guide surface over a predetermined angle.

2. Fault pre-warning apparatus in accordance with claim 1 wherein said textile manufacturing machine is a tufted carpet manufacturing machine.

3. Fault pre-warning apparatus in accordance with claim 1 wherein a single said switching strip extends over the whole width of said web.

4. Fault pre-warning apparatus in accordance with claim 1 wherein first and second rollers are disposed one before and one after said switching strip and are displaced relative to said curved guide surface in order to form the angle $\alpha$ through which said threads are wrapped around said rounded guide surface.

5. Fault pre-warning apparatus in accordance with claim 1, wherein said first and second contact bands each have first and second side edges and wherein first and second insulating strips are placed between said first side edges and between said second side edges and maintain said contact bands in spaced apart relationship.

6. Fault pre-warning apparatus in accordance with claim 1, wherein said first and second contact bands comprise resilient sheet metal strips.

7. Fault pre-warning apparatus in accordance with claim 1, wherein said first contact band has inclined slots separated by webs distributed along its length.

8. Fault pre-warning apparatus in accordance with claim 1 wherein said guide surface is part cylindrical in shape.

9. Fault pre-warning apparatus in accordance with claim 1, wherein a foil of a wear resistant resilient material is disposed between said switching strip and said threads.

10. Fault pre-warning apparatus in accordance with claim 9 wherein said foil comprises CR-steel.

11. Fault pre-warning apparatus in accordance with claim 4 wherein said switching strip and said rollers are mounted in a machine frame and wherein means is provided for varying the position of at least one of said switching strip and said rollers relative to said machine frame in order to change said angle of wrap $\alpha$.

12. Fault pre-warning apparatus in accordance with claim 1, wherein said angle of wrap $\alpha$ lies in the range from 60° to 120°.

13. Fault pre-warning apparatus in accordance with claim 12, wherein said angle of wrap $\alpha$ amounts to substantially 90°.

* * * * *